US012758066B2

(12) United States Patent
Kim et al.

(10) Patent No.: US 12,758,066 B2
(45) Date of Patent: Oct. 13, 2026

(54) CLEANER

(71) Applicant: SAMSUNG ELECTRONICS CO., LTD., Suwon-si (KR)

(72) Inventors: Hyunjoo Kim, Suwon-si (KR); Joongkeun Choi, Suwon-si (KR); Jinbaek Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 438 days.

(21) Appl. No.: 18/236,017

(22) Filed: Aug. 21, 2023

(65) Prior Publication Data

US 2024/0122420 A1 Apr. 18, 2024

Related U.S. Application Data

(63) Continuation of application No. PCT/KR2023/009405, filed on Jul. 4, 2023.

(30) Foreign Application Priority Data

Oct. 17, 2022 (KR) ..... 10-2022-0133624

(51) Int. Cl.
*A47L 5/28* (2006.01)
*A47L 9/00* (2006.01)
(Continued)

(52) U.S. Cl.
CPC ..... *A47L 5/28* (2013.01); *A47L 9/0081* (2013.01); *A47L 9/102* (2013.01); *A47L 9/1625* (2013.01); *A47L 9/1683* (2013.01)

(58) Field of Classification Search
CPC ..... A47L 5/28; A47L 5/24; A47L 5/22; A47L 9/0081; A47L 9/102; A47L 9/1625;
(Continued)

(56) References Cited

U.S. PATENT DOCUMENTS 6,003,200 A * 12/1999 Potts ..... A47L 7/0028 15/327.2
9,456,728 B2 10/2016 Danestad et al.
(Continued)

FOREIGN PATENT DOCUMENTS

CN 213574745 U 6/2021
CN 113598645 A 11/2021
(Continued)

OTHER PUBLICATIONS

International Search Report dated Oct. 23, 2023 for International Application No. PCT/KR2023/009405.
(Continued)

*Primary Examiner* — Michael A Gump
(74) *Attorney, Agent, or Firm* — STAAS & HALSEY LLP

(57) ABSTRACT

A cleaner including a body including a body exhaust vent; a filter installable inside the body; and a fan motor device including a rotatable impeller to generate a suction force inside the body, a motor to rotate the impeller, and a diffuser device including a radiating diffuser extending in a radial direction from a rotational axis of the impeller, and an axial diffuser extending from the radiating diffuser. The fan motor device is configured so that, with the filter installed inside the body, rotation of the impeller by the power provided by the motor causes air to pass through the fan motor device and be discharged from the impeller, and then guided by the radiating diffuser in the radial direction from the rotational axis of the impeller, and then guided by the axial diffuser to the filter to be filtered, and then discharged through the body exhaust vent.

15 Claims, 17 Drawing Sheets

(51) Int. Cl.
*A47L 9/10* (2006.01)
*A47L 9/16* (2006.01)

(58) Field of Classification Search
CPC ..... A47L 9/1683; A47L 9/2868; A47L 9/127; A47L 9/1641; A47L 9/1666; A47L 9/22; A47L 11/4097; F04D 29/4253; F04D 29/444; F04D 29/602; F04D 29/448; F04D 29/44; F04D 29/441; F04D 29/442
USPC ..... 15/300.1
See application file for complete search history.

(56) References Cited

U.S. PATENT DOCUMENTS

| | | | | |
|---|---|---|---|---|
| 2016/0037984 | A1* | 2/2016 | Park | F04D 29/626 15/326 |
| 2018/0333025 | A1* | 11/2018 | Nam | A47L 5/24 |
| 2019/0008346 | A1* | 1/2019 | Conrad | A47L 9/2884 |
| 2019/0113045 | A1 | 4/2019 | Diehl | |
| 2020/0237166 | A1* | 7/2020 | Adachi | F04D 29/444 |
| 2021/0401248 | A1 | 12/2021 | King et al. | |
| 2022/0325722 | A1 | 10/2022 | Barnes et al. | |
| 2023/0021359 | A1 | 1/2023 | Hwang et al. | |

FOREIGN PATENT DOCUMENTS

| | | | |
|---|---|---|---|
| EP | 3 155 947 | A1 | 4/2017 |
| EP | 3 865 712 | A1 | 8/2021 |
| KR | 10-2004-0021333 | A | 3/2004 |
| KR | 10-2009-0026919 | | 3/2009 |
| KR | 10-2019-0003260 | | 1/2019 |
| KR | 10-2017918 | B1 | 9/2019 |
| KR | 10-2021-0088613 | A | 7/2021 |
| KR | 10-2021-0153940 | A | 12/2021 |
| KR | 10-2022-0037540 | A | 3/2022 |
| KR | 10-2022-0045717 | | 4/2022 |
| KR | 10-2022-0058602 | | 5/2022 |
| KR | 10-2022-0111968 | A | 8/2022 |

OTHER PUBLICATIONS

Written Opinion of the International Searching Authority dated Oct. 23, 2023 for International Application No. PCT/KR2023/009405.
Extended European Search Report dated Aug. 20, 2025 for European Application No. 23879934.0.

* cited by examiner

CLEANER

CROSS-REFERENCE TO RELATED APPLICATION

This application is a continuation application, under 35 U.S.C. § 111(a), of international application No. PCT/KR2023/009405, filed on Jul. 4, 2023, which claims priority to Korean Patent Application No. 10-2022-0133624, filed on Oct. 17, 2022, in the Korean Intellectual Property Office, the disclosures of which are incorporated by reference herein in their entireties.

BACKGROUND

1. Field

The disclosure relates to a cleaner having a diffuser.

2. Description of the Related Art

A cleaner is an appliance for cleaning indoor space by removing rubbish from the indoor space. In homes, vacuum cleaners are commonly used. The vacuum cleaners clean indoor space by intaking air with a suction force of a fan motor device and then separating rubbish from the intaken air through a device such as a filter or the like. The vacuum cleaners are classified into a canister type and an upright type. Recently, a robot cleaner that itself travels on a cleaning area without a user's control to perform a cleaning task by intaking rubbish such as dust from a floor to be cleaned has become popular.

A cleaner includes a fan motor device for generating a suction force. The fan motor device intakes outside air and rubbish into the inside of the cleaner and then discharges air from which the rubbish has been filtered to the outside of the cleaner.

The fan motor device includes an impeller, and a diffuser for diffusing air discharged from the impeller. The diffuser increases the efficiency of the fan motor device by diffusing air discharged from the impeller. Because the diffuser extends in a rotational axis direction of the impeller, the length and/or weight of the cleaner may increase.

SUMMARY

Aspects of embodiments of the disclosure will be set forth in part in the description which follows and, in part, will be apparent from the description, or may be learned by practice of the presented embodiments.

According to an embodiment of the disclosure, a cleaner includes a body including a body exhaust vent; a filter installable inside the body; and a fan motor device including an impeller configured to be rotatable to generate a suction force inside the body, a motor configured to provide power to rotate the impeller, and a diffuser device including a radiating diffuser extending in a radial direction from a rotational axis of the impeller, and an axial diffuser extending from the radiating diffuser. The fan motor device is configured so that, with the filter installed inside the body, rotation of the impeller by the power provided by the motor causes air to pass through the fan motor device and be discharged from the impeller, and then guided by the radiating diffuser in the radial direction from the rotational axis of the impeller, and then guided by the axial diffuser to the filter to be filtered, and then discharged through the body exhaust vent.

According to an embodiment of the disclosure, the radiating diffuser may include a radiating blade configured to diffuse the air guided by the radiating diffuser.

According to an embodiment of the disclosure, the axial diffuser may include an axial blade configured to diffuse the air guided by the axial diffuser.

According to an embodiment of the disclosure, the axial diffuser may includes a first axial diffuser extending from the radiating diffuser, and a second axial diffuser extending from the first axial diffuser.

According to an embodiment of the disclosure, the first axial diffuser may include a first axial blade configured to diffuse air guided by the first axial diffuser, and the second axial diffuser may include a second axial blade configured to diffuse air guided by the second axial diffuser.

According to an embodiment of the disclosure, the radiating diffuser may include a first radiating diffuser extending in a direction in which the impeller discharges air.

According to an embodiment of the disclosure, the radiating diffuser may include a second radiating diffuser extending from the first radiating diffuser in a direction that is perpendicular to the rotational axis of the impeller.

According to an embodiment of the disclosure, the axial diffuser may be configured to discharge air the air guided by the axial diffuser in a direction toward the filter with the filter installed inside the body.

According to an embodiment of the disclosure, the motor may be positioned to a side of the impeller opposite to the diffuser device for intake of air.

According to an embodiment of the disclosure, with the filter installed inside the body, the filter may surround the fan motor device in a circumferential direction with respect to the rotational axis of the impeller.

According to an embodiment of the disclosure, the diffuser device may be configured to discharge air toward one side of the impeller for intake of air.

According to an embodiment of the disclosure, the diffuser device may include an outlet to discharge the air guided by the axial diffuser, the outlet being positioned adjacent to a first side of the filter with the filter installed inside the body, and the body exhaust vent may be positioned adjacent to a second side of the filter opposite to the first side of the filter with the filter installed inside the body.

According to an embodiment of the disclosure, the diffuser device may include an outlet to discharge the air guided by the axial diffuser, and the filter may extend from the outlet of the diffuser device to the body exhaust vent with the filter installed inside the body.

According to an embodiment of the disclosure, the filter may be a high efficiency particulate air (HEPA) filter.

According to an embodiment of the disclosure, the filter may be detachable from the body.

BRIEF DESCRIPTION OF THE DRAWINGS

These and/or other embodiments of the disclosure will become apparent and more readily appreciated from the following description of the embodiments, taken in conjunction with the accompanying drawings of which.

DETAILED DESCRIPTION

Figure 1:
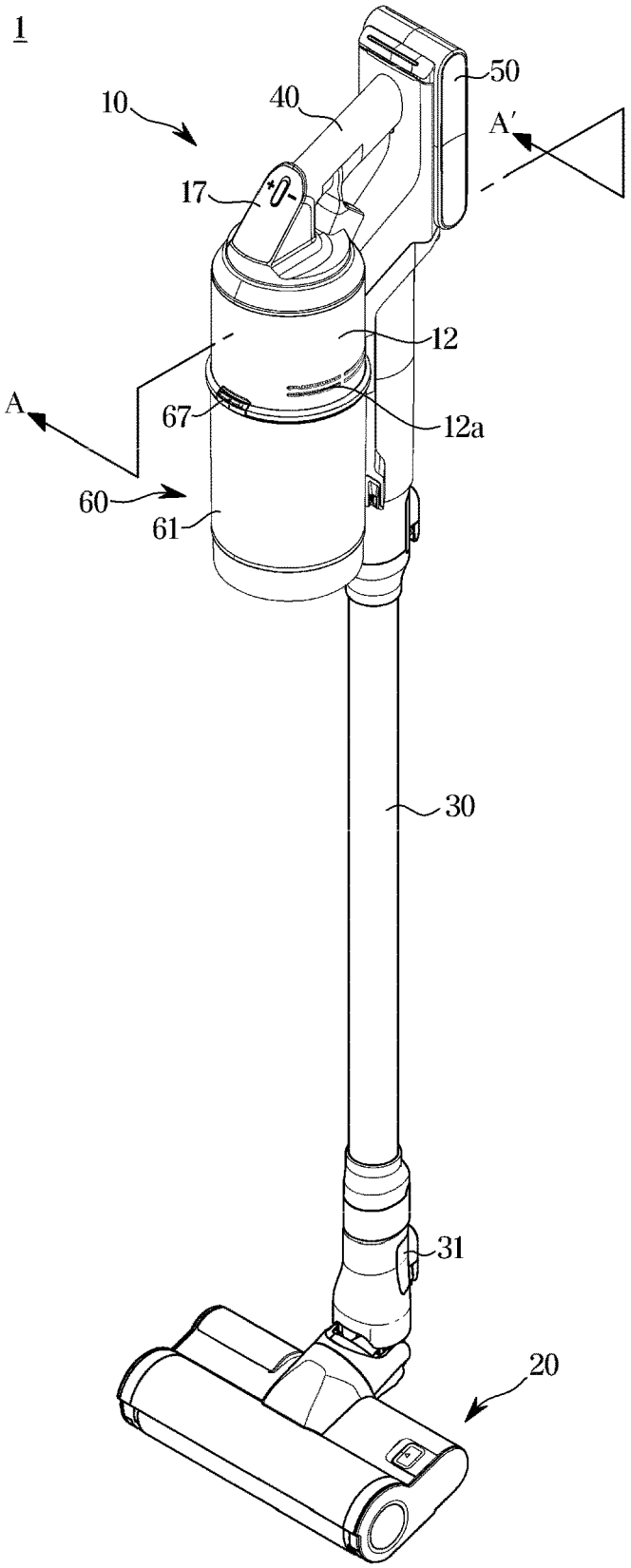
FIG. 1 shows a cleaner according to an embodiment of the disclosure.

Various embodiments of the present disclosure and terms used therein are not intended to limit the technical features described in the present disclosure to particular embodiments, and it should be construed as including various modifications, equivalents, or alternatives of a corresponding embodiment.

With regard to description of drawings, similar reference numerals may be used for similar or related components.

A singular form of a noun corresponding to an item may include one item or a plurality of the items unless context clearly indicates otherwise.

As used herein, each of the expressions "A or B," "at least one of A and B," "at least one of A or B," "A, B, or C," "at least one of A, B, and C," and "at least one of A, B, or C," may include one or all possible combinations of the items listed together with a corresponding expression among the expressions.

The term "and/or" includes any and all combinations of one or more of a plurality of associated listed items.

It will be understood that the terms "first", "second", etc., may be used only to distinguish one component from another, not intended to limit the corresponding component in other aspects (e.g., importance or order).

It is said that one (e.g., first) component is "coupled" or "connected" to another (e.g., second) component, with or without the terms "functionally" or "communicatively". When referenced, it means that one component can be connected to the other component directly (e.g., by wire), wirelessly, or through a third component.

It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

An expression that one component is "connected", "coupled", "supported", or "in contact" with another component includes a case in which the components are directly "connected", "coupled", "supported", or "in contact" with each other and a case in which the components are indirectly "connected", "coupled", "supported", or "in contact" with each other through a third component.

It will also be understood that when one component is referred to as being "on" or "over" another component, it can be directly on the other component or intervening components may also be present.

Embodiments of the disclosure may provide a cleaner of which a length is capable of being reduced. Embodiments of the disclosure may provide a cleaner of which a weight is capable of being reduced. Embodiments of the disclosure may provide a cleaner capable of improving efficiency. Embodiments of the disclosure may provide a cleaner capable of increasing heat dissipation efficiency of a motor.

The technical objectives of the present disclosure are not limited to those described herein, and other objectives not described herein may become apparent or understood by a person who has a common knowledge in the technical field to which the disclosure pertains from the following detailed description.

Hereinafter, an embodiment of the disclosure will be described in detail with reference to the accompanying drawings.

Hereinafter, for convenience of description, although a stick type cleaner which is a kind of vacuum cleaner will be described as an example, a configuration of the disclosure is not limited to the stick type cleaner. For example, a configuration of the disclosure may also be applied to a canister type cleaner, a robot cleaner, etc.

Figure 2:
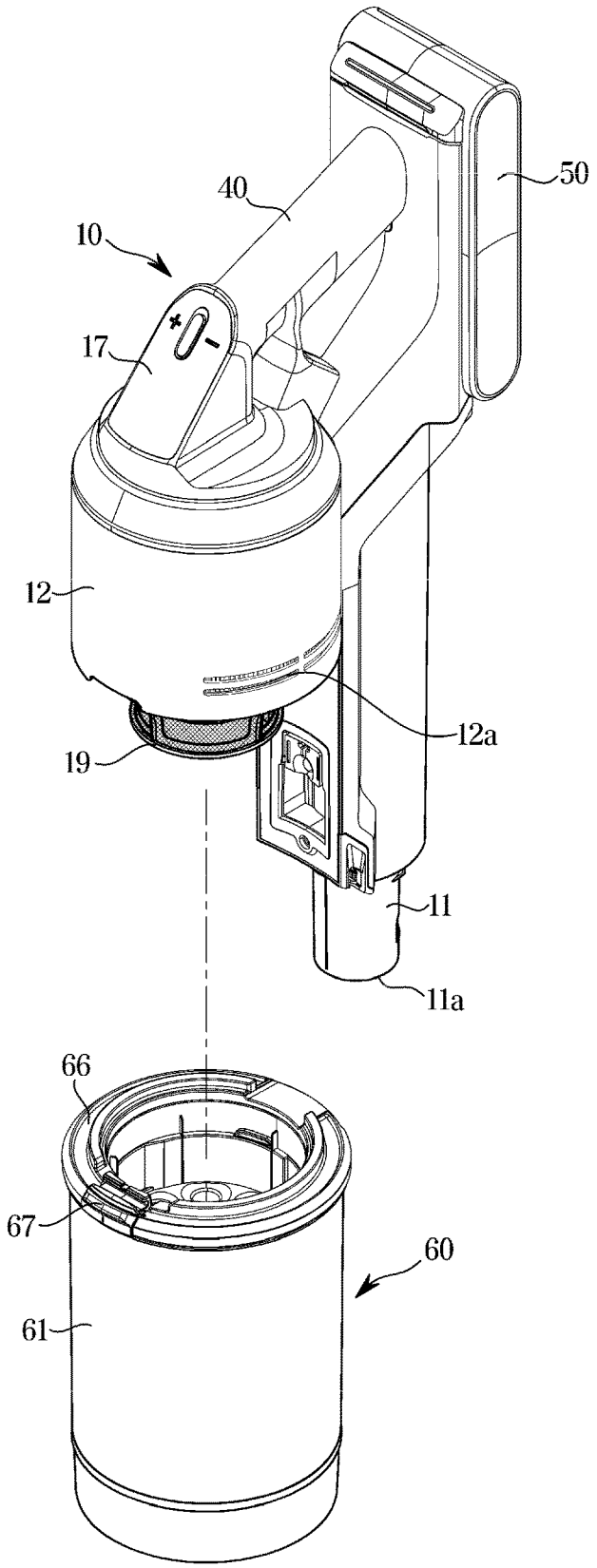
FIG. 2 is an exploded view of some components of the cleaner shown in FIG. 1.
Figure 3:
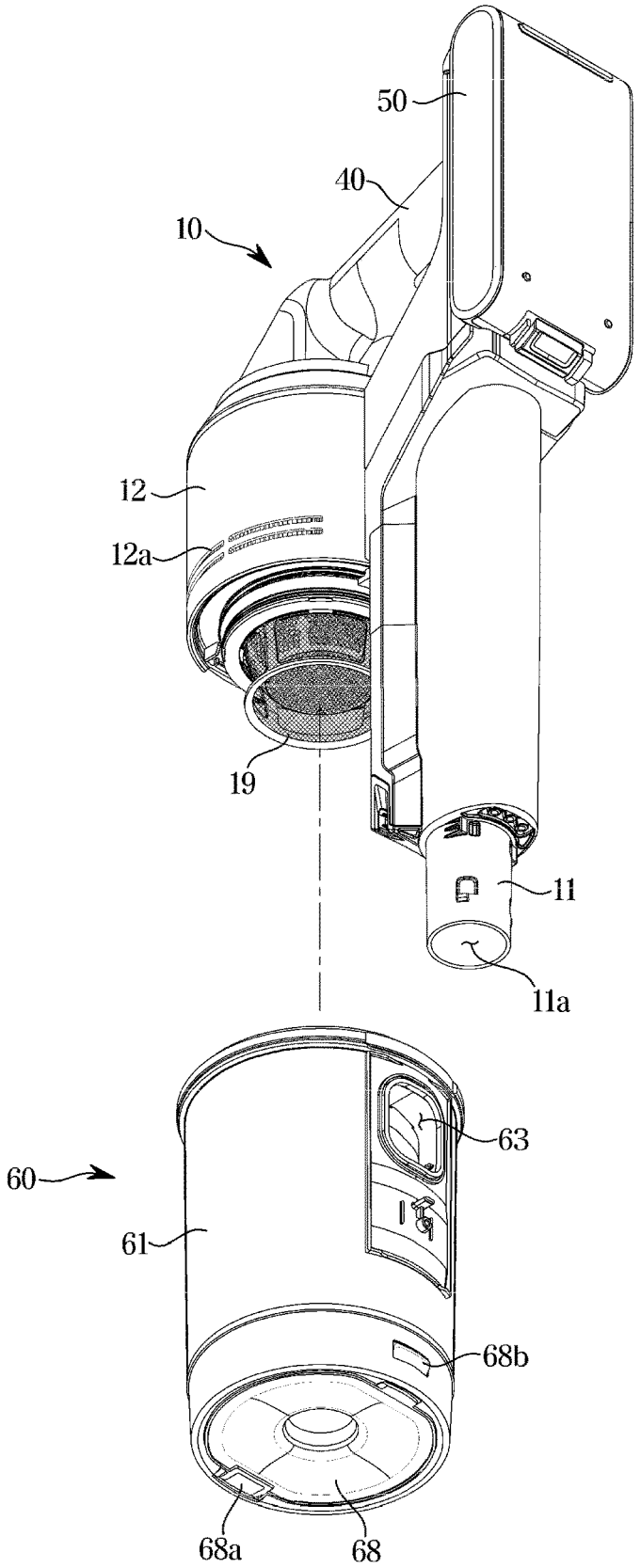
FIG. 3 shows some components of the cleaner shown in FIG. 2 in another direction than in FIG. 2.

FIG. 1 shows a cleaner according to an embodiment of the disclosure. FIG. 2 is an exploded view of some components of the cleaner shown in FIG. 1. FIG. 3 shows some components of the cleaner shown in FIG. 2 in another direction than in FIG. 2.

Figure 4:
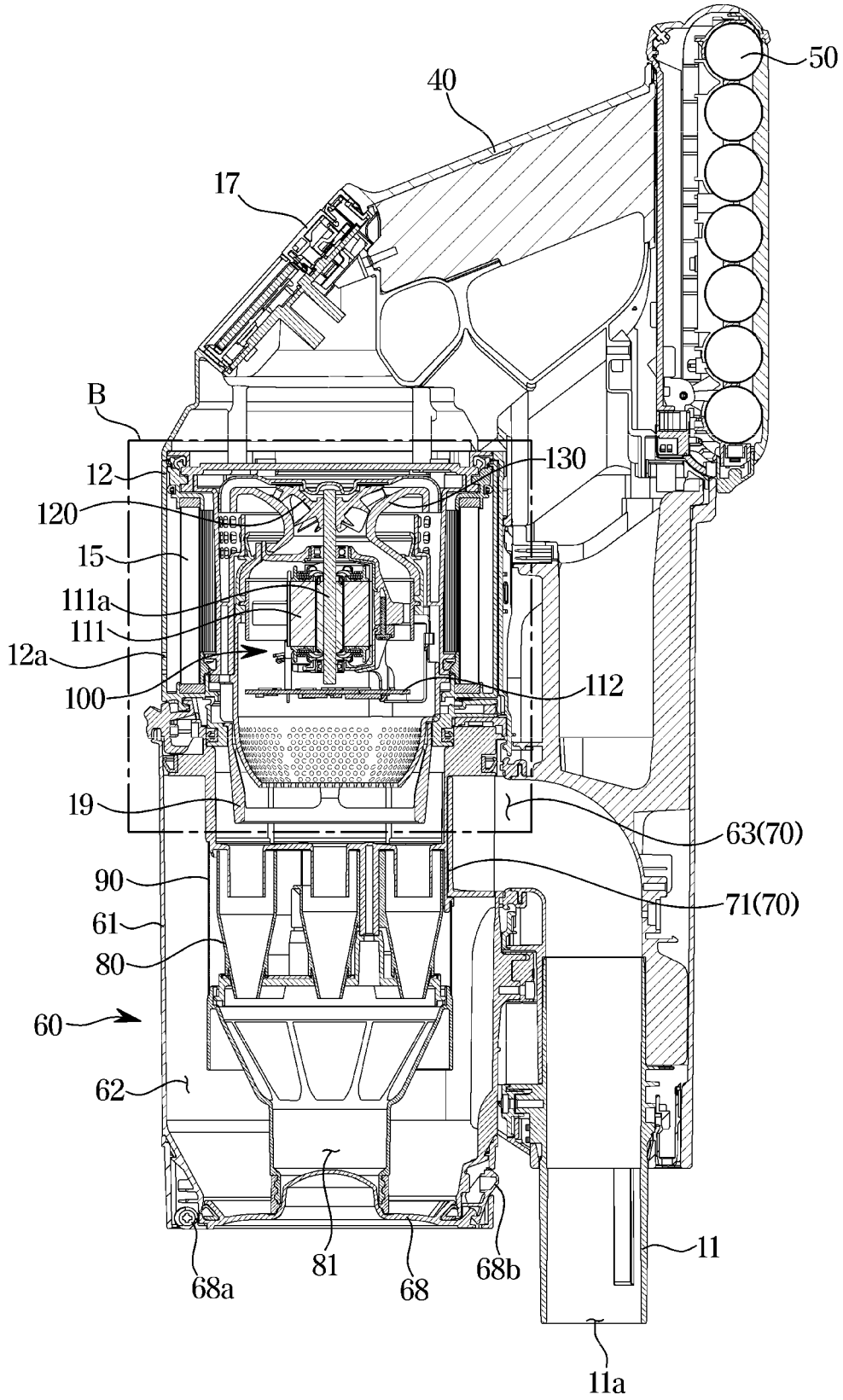
FIG. 4 shows a cross section taken along line A-A' denoted in FIG. 1.

FIG. 4 shows a cross section taken along line A-A' denoted in FIG. 1.

Referring to FIGS. 1 to 4, a cleaner 1 may include a suction head 20 for intaking foreign materials such as dust existing on a surface to be cleaned by a suction force of air, and a body 10 for collecting foreign materials intaken through the suction head 20.

The cleaner 1 may include a connecting pipe 30 connecting the suction head 20 to the body 10.

The suction head 20 may include a suction brush (not shown) and intake air and foreign materials on a surface to be cleaned by being in close contact with the surface to be cleaned. The suction head 20 may be rotatably coupled to the connecting pipe 30.

The connecting pipe 30 may be formed as a pipe having certain stiffness or a flexible hose. The connecting pipe 30 may transfer a suction force generated by a motor 111 to the suction head 20, and guide air and foreign materials such as dust, intaken through the suction head 20, to the body 10.

The connecting pipe 30 may further include a suction head connector 31. The suction head connector 31 may separate the suction head 20 from the body 10 or couple the suction head 20 to the body 10.

The body 10 may include a fan motor device 100 configured to generate a suction force with respect to a surface to be cleaned, a dust collecting device 60 configured to separate dust from intaken air and collect the dust, a handle 40 that is capable of being gripped by a user, and a battery 50 for supplying power required to drive components of the cleaner 1, such as the motor 111, etc.

The body 10 may include a body intake port 11*a* through which air and foreign materials are intaken into the body 10, and a body exhaust vent 12*a* through which air is discharged to outside of the body 10. The body 10 may include a body intake duct 11 that communicates with one end of the connecting pipe 30, and the body intake port 11*a* may be formed at one end of the body intake duct 11, the one end being connected to one end of the connecting pipe 30, among both ends of the body intake duct 11. Air and foreign materials intaken by the suction head 20 may pass through the connecting pipe 30 and enter the inside of the body 10 through the body intake port 11*a* of the body intake duct 11, although embodiments of the disclosure are not limited thereto. For example, the body 10 may not include a duct structure such as the body intake duct 11, and the body intake port 11*a* may be connected directly to the connecting pipe 30.

The body 10 may include an exhaust case 12, and in an outer circumference of the exhaust case 12, the body exhaust vent 12*a* for discharging air to the outside of the body 10 may be formed.

The body 10 may include a filter 15 for filtering foreign materials from inside air of the body 10 before the air is discharged to the outside of the body 10 through the body exhaust vent 12*a*. The filter 15 may be a high efficiency particulate air (NEPA) filter, although embodiments of the disclosure are not limited thereto.

The body 10 may include a controller 17. A user may turn on/off the cleaner 1 or adjust a suction strength by controlling a power button, etc., provided in the controller 17.

In the body 10, the dust collecting device 60 may be provided. The dust collecting device 60 may be positioned upstream of the motor 111 along a flow direction of inside air of the body 10 by the fan motor device 100 to separate foreign materials from air entered the dust collecting device 60 and collect the separated foreign materials.

The dust collecting device 60 may include a dust collecting case 61 for collecting foreign materials separated from air. The dust collecting case 61 may form an appearance of the dust collecting device 60. The dust collecting case 61 may form a dust collecting chamber 62 in which foreign materials separated from air is collected. The dust collecting chamber 62 may be a space in which foreign materials separated by a first dust collecting device (first cyclone) 70 are collected, and the dust collecting chamber 62 may be referred to as a first dust collecting chamber 62. Likewise, the dust collecting case 61 forming the first dust collecting chamber 62 may be referred to as a first dust collecting case 61.

At one side of the first dust collecting case 61, an inlet 63 through which air enters inside of the first dust collecting chamber 62 from the suction head 20 may be formed. The inlet 63 may communicate with the body intake duct 11, and air entering the inside of the body 10 through the body intake port 11*a* may enter inside of the dust collecting device 60 through the inlet 63. The inlet 63 may be referred to as a first cyclone inlet 63 in that air and foreign materials enter the first cyclone 70.

The dust collecting device 60 may be coupled to the body 10 in such a way as to be detachable from another component of the body 10. The dust collecting device 60 may include a connecting cover 66 for connecting the dust collecting device 60 to the other component of the body 10, and a coupling button 67 provided at one side of the connecting cover 66 to detachably couple the dust collecting device 60 to the other component of the body 10. More specifically, as shown in FIGS. 1 to 4, the connecting cover 66 and the coupling button 67 may be positioned between the exhaust case 12 and the first dust collecting case 61.

The coupling button 67 may be hook-coupled to one side of the body 10. By hook-coupling the coupling button 67 to one side of the body 10, the dust collecting device 60 may be installed in the body intake port 11*a*.

In a case in which a user presses the coupling button 67 of the dust collecting device 60 installed in the body 10, the coupling button 67 may be released and the dust collecting device 60 may be separated from the body 10.

After the dust collecting device 60 is separated from the other component of the body 10, the user may perform various operations, such as removing foreign materials collected in the dust collecting device 60, cleaning the dust collecting device 60, or repairing or replacing components of the dust collecting device 60 or the body 10, although embodiments of the disclosure are not limited thereto. However, the dust collecting device 60 may be separated from the body 10 by various methods.

The dust collecting device 60 may include a dust collecting case door 68 provided in the first dust collecting case 61. The dust collecting case door 68 may be provided at one side of the first dust collecting case 61 to open or close the first dust collecting chamber 62. In addition, the dust collecting case door 68 may open or close a second dust collecting chamber 81.

The dust collecting case door 68 may be rotatable with respect to the first dust collecting case 61 by a rotating shaft 68*a*. The dust collecting case door 68 may include a door button 68*b*, and the door button 68*b* may be hook-coupled to one side of the first dust collecting case 61. Upon hook-coupling of the door button 68*b* to one side of the first dust collecting case 61, the dust collecting case door 68 may be maintained in a closed state. In a case in which a user presses the door button 68*b* while the dust collecting case door 68 is in a closed state, the door button 68*b* may be released and the dust collecting case door 68 may open.

Accordingly, the user may easily remove foreign materials collected in the first dust collecting chamber 62 and the second dust collecting chamber 81 without separating the dust collecting device 60 from the body 10 or disassembling a component such as the dust collecting case 61 of the dust collecting device 60. However, the above description about the dust collecting case door 68 is only an example for removing collected foreign materials from the dust collecting device 60 of the cleaner 1 according to a concept of the disclosure, and a concept of the disclosure is not limited to this.

The dust collecting device 60 may include a first dust collecting device 70 for primarily separating air and foreign materials received through the first cyclone inlet 63, and a second dust collecting device 80 for receiving air from which foreign materials have been separated by the first dust collecting device 60 and which has been discharged from the first dust collecting device 70 and secondarily separating foreign materials from the air.

Each of the first dust collecting device 70 and the second dust collecting device 80 may be a cyclone type dust collecting device.

The cyclone type dust collecting device may separate foreign materials by a centrifugal force generated according to a rotational flow of air and foreign materials therein, wherein an inlet which air enters may have a structure capable of guiding a rotational flow of air, such as a helical inlet, a tangential-direction inlet, a guide vane inlet, etc.

For example, the first dust collecting device 70 may include a first cyclone guide 71 for guiding air and foreign materials received through the first cyclone inlet 63 to rotate and flow. Also, the second dust collecting device 80 may include an inlet duct for guiding air and foreign materials discharged from the first dust collecting device 70 to enter the second dust collecting device 80 and then rotate and flow.

Foreign materials primarily separated by the first dust collecting device 70 may include foreign materials having relatively large sizes. For example, in the first dust collecting device 70, a rotational radius of air flowing by the first cyclone guide 71 may be relatively great, and the first dust collecting chamber 62 may also be large correspondingly.

The second dust collecting device 80 may separate foreign materials having relatively small sizes, not sufficiently separated by the first dust collecting device 70, from air.

A cyclone cover 90 may be positioned between the first dust collecting device 70 and the second dust collecting device 80. Air and foreign materials discharged from the first dust collecting device 70 may pass through the cyclone cover 90 and then enter the second dust collecting device 80. In other words, the cyclone cover 90 may function as an outlet of the first dust collecting device 70 and as an inlet of the second dust collecting device 80.

Due to a suction force generated by the fan motor device 100 inside the body 10, air and foreign materials may be intaken into the suction head 20. Air and dust intaken into the suction head 20 may pass through the connecting pipe 30 and the body intake port 11*a* and be intaken into the inside of the body 10. Air entering the inside of the body 10 may enter the dust collecting device 60 via the inlet (first cyclone inlet) 63. Foreign materials entering the dust collecting device 60 may be primarily separated by the first dust collecting device 70 and collected in the first dust collecting chamber 62. Air from which foreign materials have been separated by the first dust collecting device 70 may be discharged from the first dust collecting device 70 through the cyclone cover 90 and enter the second dust collecting device 80. Foreign materials entering the second dust collecting device 80 may be secondarily separated by the second dust collecting device 80 and collected in the second dust collecting chamber 81. Air from which foreign materials have been separated by the second dust collecting device 80 may flow to the fan motor device 100, be filtered once more by the filter 15, and then discharged to the outside of the body 10 through the body exhaust vent 12*a*.

However, unlike the above description, in some embodiments of the disclosure the first dust collecting device 70 may be not a cyclone type dust collecting device. For example, the first dust collecting device according to a concept of the disclosure, which is a dust collecting device for primarily separating foreign materials from air received from the suction head, may be one of various types of dust collecting devices, such as, for example, a type of dust collecting device that separates foreign materials through a porous filter.

The cleaner 1 may include a fan motor filter 19 for filtering foreign materials from air passed through the dust collecting device 60 while the air moves to the fan motor device 100. The fan motor filter 19 may include a plurality of holes.

Figure 5:
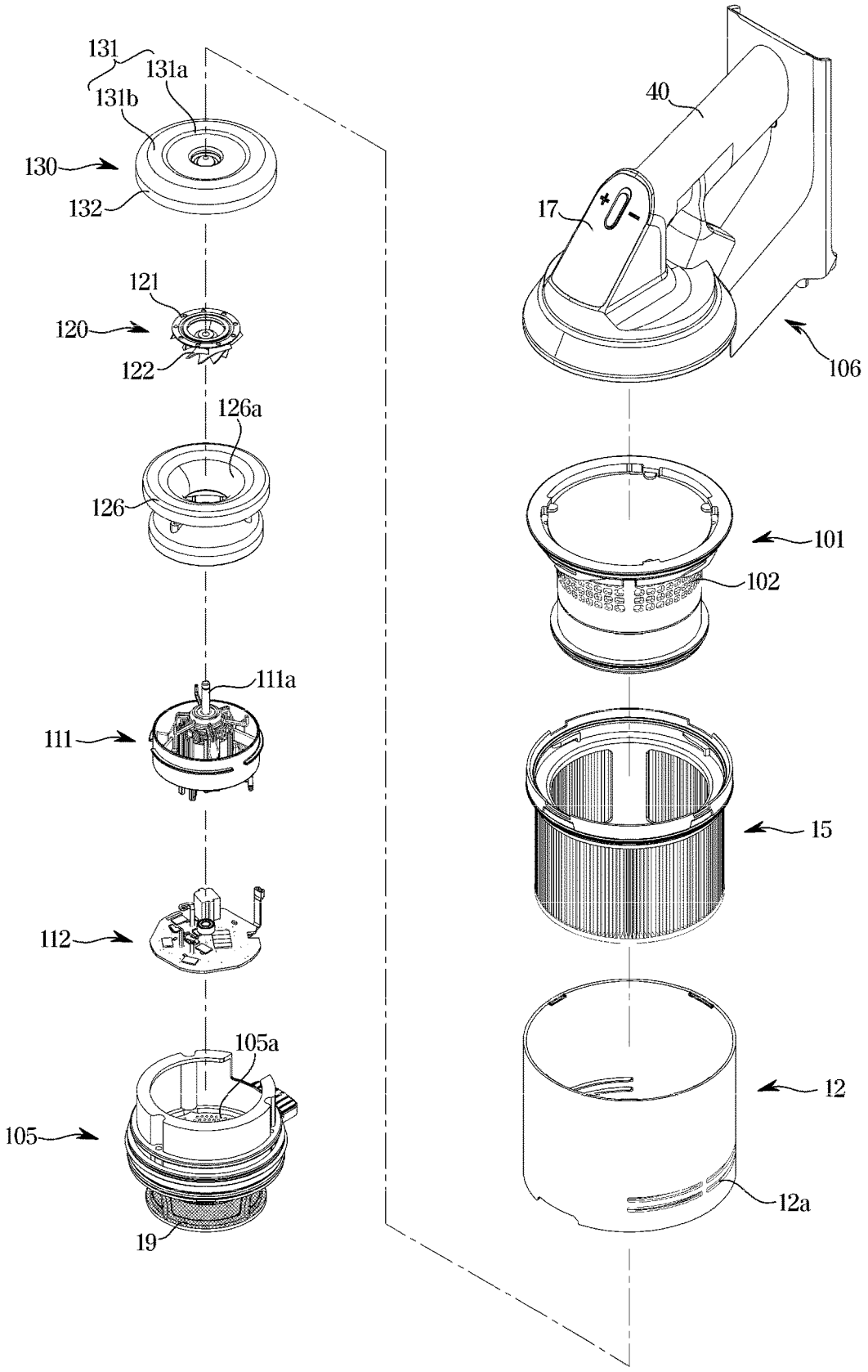
FIG. 5 is an exploded view of some components of a body shown in FIG. 4.
Figure 6:
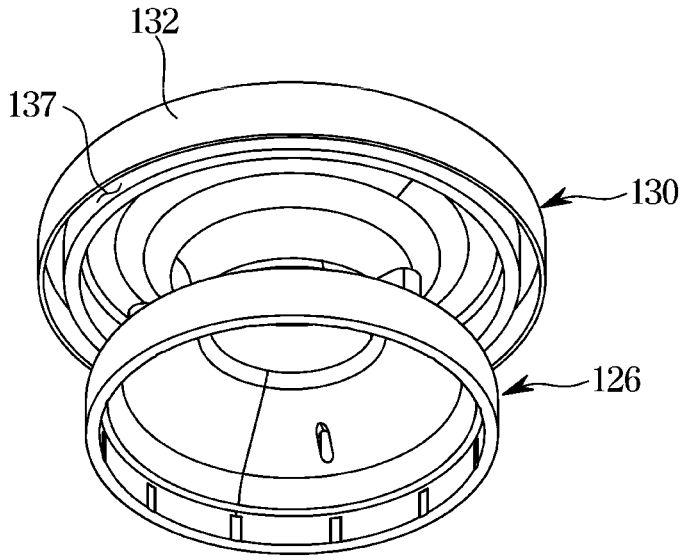
FIG. 6 shows a coupled state of an impeller cover and a diffuser device shown in FIG. 5 according to an embodiment of the disclosure.
Figure 7:
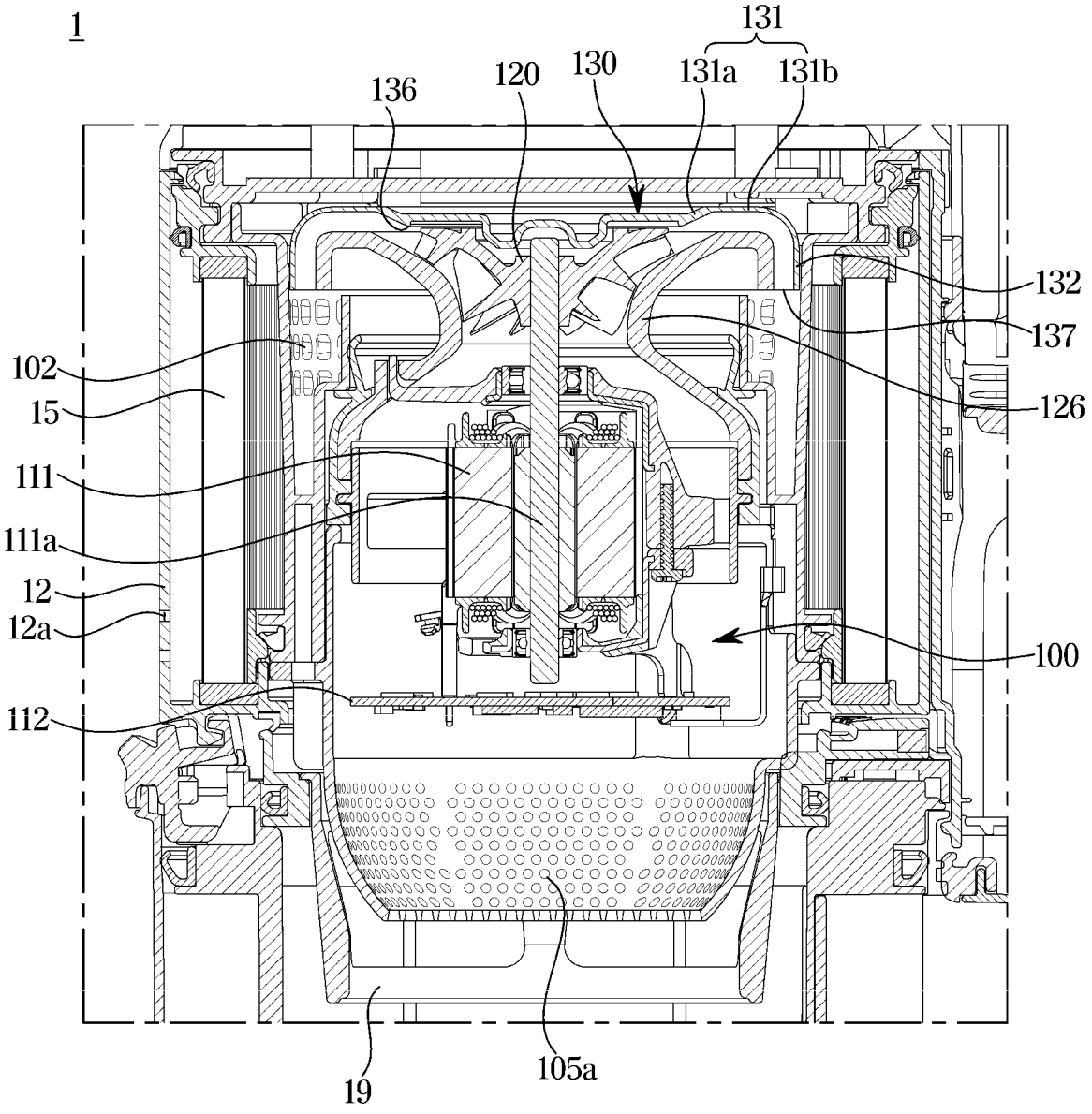
FIG. 7 is an enlarged view of a B area denoted in FIG. 4.

FIG. 5 is an exploded view of some components of a body shown in FIG. 4. FIG. 6 shows a coupled state of an impeller cover and a diffuser device shown in FIG. 5. FIG. 7 is an enlarged view of a B area denoted in FIG. 4.

Referring to FIGS. 5 to 7, the body 10 may include a main body 101. A fan motor device 110 may be accommodated inside the main body 101. The main body 101 may include a connecting vent 102 for discharging air to the filter 15. The connecting vent 102 may be formed along a circumference of the main body 101. The connecting vent 102 may guide air passed through the fan motor device 100 to the filter 15.

The body 10 may include a body cover 106 detachably installed in the main body 101. The body cover 106 may be detachably installed in the exhaust case 12. The handle 40 and the controller 17 may be provided in the body cover 106. The body cover 106 may cover an open side of the main body 101.

The exhaust case 12 may be detachably coupled to the body cover 106. The exhaust case 12 may include the body exhaust vent 12*a* through which air passed through the filter 15 is discharged to the outside of the body 10. Inside air of the cleaner 1 may be discharged to the outside of the cleaner 1 through the body exhaust vent 12*a*. For example, the body exhaust vent 12*a* may be in a shape of a slit. For example, the body exhaust vent 12*a* may be in a shape of a hole. The body exhaust vent 12*a* may be formed along the outer circumference of the exhaust case 12.

The filter 15 may be accommodated in the exhaust case 12. The filter 15 may filter foreign materials from air discharged from the connecting vent 102 of the main body 101. The filter 15 may be positioned inside the body 10 to filter air passed through the fan motor device 100. The filter 15 may surround the fan motor device 100 in a circumferential direction with respect to a rotational axis of an impeller 120.

At least one portion of the filter 15 may face the connecting vent 102. The filter 15 may extend along a circumferential surface of the body 10 in which the connecting vent 102 is formed. The filter 15 may extend from the connecting vent 102 up to the body exhaust vent 12*a*. Because the filter 15 extends from the connecting vent 102 up to the body exhaust vent 12*a*, air entering a space between the exhaust case 12 and the main body 101 through the connecting vent 102 may be filtered by passing through the filter 15 and then discharged through the body exhaust vent 12*a*. The filter 15 may surround the connecting vent 102. The filter 15 may be substantially in a shape of a cylinder of which both ends are open.

The filter 15 may be detachably installed in the body 10. The filter 15 may be detachably installed in the main body 101 and/or the body cover 106. A user may manage and/or repair the filter 15 by separating the filter 15 from the body 10.

The exhaust case 12 may cover the filter 15. The exhaust case 12 may be detachably coupled to the body cover 106 and/or the main body 101. Because the exhaust case 12 is detachably coupled to the body cover 106 and/or the main body 101, the user may easily replace the filter 15.

For example, the filter 15 may be a NEPA filter. The filter 15 may filter rubbish having fine sizes, such as fine dust, from air passed through the dust collecting device 60. Air from which fine dust has been filtered by passing through the filter 15 may be discharged to the outside of the cleaner 1 through the body exhaust vent 12*a* of the exhaust case 12.

The fan motor device 100 for generating a suction force required to intake rubbish on a surface to be cleaned may be included inside the body 10. The fan motor device 100 may be accommodated inside the body 10. The fan motor device 100 may be configured to generate a suction force inside the body 10.

The fan motor device 100 may include the motor 111, and a circuit board 112 for controlling the motor 111. The circuit board 112 may be positioned to a side of the motor 11, the side being opposite to another side of the motor 111 to which the impeller 120 is coupled. The motor 111 and/or the circuit board 112 may be positioned to a side of the impeller 120 for intake of air.

The motor 111 may perform a function of converting an electromagnetic force to a mechanical rotational force. To perform the function, the motor 111 may include a stator having a coil, a rotor having magnetism and being rotatable by an electromagnetic force, and a motor shaft 111*a* penetrating the rotor and being rotatable. Inside the body 10, the impeller 120 connected to the motor 111 through the motor shaft 111*a* of the motor 111 may be provided.

The motor 111 may be positioned to a side of the impeller 120, the side being opposite to the other side of the impeller 120 to which a diffuser device 130 is positioned. The motor 111, the impeller 120, and the diffuser device 130 may be arranged in order in a direction which air passed through the dust collecting device 60 is discharged to the outside of the cleaner 1. Because the motor 111, the impeller 120, and the diffuser device 130 are arranged in order in the direction which air passed through the dust collecting device 60 is discharged to the outside of the cleaner 1, air having relatively low temperature may pass through the motor 111, resulting in an increase of heat dissipation efficiency of the motor 111.

The body 10 may include a motor case 105 in which the motor 111 and/or the circuit board 112 are installed. The motor 111 and/or the circuit board 112 may be accommodated inside the motor case 105. The motor case 105 may cover the motor 111 and/or the circuit board 112. The motor case 105 may be accommodated inside the main body 101. The motor case 105 may be coupled to the main body 101.

The fan motor filter 19 may be provided in the motor case 105. The fan motor filter 19 may include a mesh portion. The motor case 105 may include a fan motor inlet 105*a* through which air passed through the fan motor filter 19 enters the fan motor device 100. The fan motor inlet 105*a* may include a plurality of holes.

The fan motor device 100 may include the impeller 120 coupled to the motor 111 to generate a flow of air. The motor 111 may provide power to the impeller 120. The impeller 120 may rotate by receiving power from the motor 111. The impeller 120 may be connected to the motor shaft 111*a*. The impeller 120 may receive power through the motor shaft 111*a* of the motor 111. According to coupling of the impeller 120 to the motor shaft 111*a*, the impeller 120 may rotate together with the motor shaft 111*a*. The impeller 120 may generate a suction force.

The impeller 120 may include a hub 121, and a plurality of blades 122 protruding from the hub 121 and forming a flow of air.

The hub 121 may have a shape of which a cross section being perpendicular to the rotational axis of the impeller 120 increases toward a direction in which air entering the body 10 is discharged. The impeller 120 may discharge air entering in a rotational axis direction of the impeller 120 in a substantially radial direction of the impeller 120.

The plurality of blades 122 may extend from the hub 121. The plurality of blades 122 may form an air current together with the hub 121 according to a rotation of the impeller 120. The plurality of blades 122 may extend from a surface of the hub 121, which air enters.

The fan motor device 100 may include an impeller cover 126 for covering the impeller 120. The impeller cover 126 may cover at least one portion of the motor 111. The impeller cover 126 may be coupled to one side of the motor 111. The impeller cover 126 may form a flow path for guiding air discharged from the impeller 120 together with the diffuser device 130.

The impeller cover 126 may include an impeller accommodating portion 126*a* corresponding to the impeller 120 to accommodate the impeller 120. The impeller accommodating portion 126*a* may have a shape of which a cross section increases in a flow direction of air. According to the configuration, the fan motor device 100 may improve efficiency.

The fan motor device 100 may include the diffuser device 130. The diffuser device 130 may guide air discharged from the impeller 120. The diffuser device 130 may diffuse air discharged from the impeller 120. The diffuser device 130 may discharge air in a direction that is parallel to the rotational axis of the impeller 120. The diffuser device 130 may be substantially in a shape of a disk. The diffuser device 130 may extend in a radial direction from the rotational axis of the impeller 120.

The diffuser device 130 may include a radiating diffuser 131 extending to guide air discharged from the impeller 120 in the radial direction from the rotational axis of the impeller 120, and an axial diffuser 132 extending to guide air passed through the radiating diffuser 131 to the filter 15.

The radiating diffuser 131 may extend substantially in the radial direction from the rotational axis of the impeller 120. Air entering the diffuser device 130 may be guided substantially in the radial direction from the rotational axis of the impeller 120 by the radiating diffuser 131. The radiating diffuser 131 may be formed such that a cross section being perpendicular to the rotational axis of the impeller 120 increases toward the radial direction from the rotational axis of the impeller 120.

Efficiency of the fan motor device 100 may depend on vacuum pressure of air passing through the diffuser device 130 at a constant airflow volume by the impeller 120. As the cross section of the radiating diffuser 131 being perpendicular to the rotational axis of the impeller 120 increases toward the radial direction from the rotational axis of the impeller 120, flow velocity of air may be reduced. According to the reduction in flow velocity of air passing through the radiating diffuser 131, vacuum pressure may increase. According to the increase in vacuum pressure of air passing through the radiating diffuser 131, the efficiency of the fan motor device 100 may increase.

The radiating diffuser 131 may include a first radiating diffuser 131*a* extending in a direction in which the impeller 120 discharges air, and a second radiating diffuser 131*b* extending from the first radiating diffuser 131*a* in a direction that is substantially perpendicular to the rotational axis of the impeller 120.

Because the diffuser device 130 includes the first radiating diffuser 131*a* extending in the direction in which the impeller 120 discharges air, generation of turbulence by high-velocity air discharged from the impeller 120 may be reduced.

Because the generation of turbulence by air discharged from the impeller 120 is reduced, the diffuser device 130 may reduce noise.

A portion of the impeller cover 126, being adjacent to an outlet of the impeller 120, may extend in a direction of air discharged from the impeller 120. The portion of the impeller cover 126, being adjacent to the outlet of the impeller 120, may guide air discharged from the impeller 120 together with the first radiating diffuser 131*a* to reduce the generation of turbulence. A diffuser inlet 136 may be formed by the diffuser device 130 and the impeller cover 126.

The impeller cover 126 may include a portion corresponding to the second radiating diffuser 131*b*. The impeller cover 126 may have a portion extending to be substantially parallel to the rotational axis direction of the impeller 120. A diffuser outlet 137 may be formed by the diffuser device 130 and the impeller cover 126. The diffuser outlet 137 may be formed by the second radiating diffuser 131*b* and the impeller cover 126.

The axial diffuser 132 may extend from the radiating diffuser 131. The axial diffuser 132 may extend from the second radiating diffuser 131*b*. The axial diffuser 132 may extend in the direction that is substantially parallel to the rotational axis of the impeller 120. The axial diffuser 132 may guide air in an opposite direction of the direction in which the impeller 120 discharges air. The axial diffuser 132 may discharge air passed through the radiating diffuser 131 toward the side of the impeller 120 for intake of air.

The diffuser device 130 may discharge air toward the side of the impeller 120, which intakes air. In the diffuser device 130, the diffuser inlet 136 through which air is received through the impeller 120 and the diffuser outlet 137 through which air entering through the diffuser inlet 136 is discharged may be formed toward the substantially same direction.

The diffuser outlet 137 may be adjacent to one side of the filter 15. The body exhaust vent 12*a* may be adjacent to another side of the filter 15, which is opposite to the one side of the filter 15. The filter 15 may extend from the diffuser outlet 137 down to the body exhaust vent 12*a*.

Because the axial diffuser 132 discharges air in the opposite direction of the direction in which the impeller 120 discharges air, the body 10 may be prevented from increasing in length in the rotational axis direction of the impeller 120. Because the cleaner 1 according to an embodiment of the disclosure is capable of reducing the length of the body 10 in the rotational axis direction of the impeller 120, a total length and a total weight of the cleaner 1 may be reduced.

Figure 8:
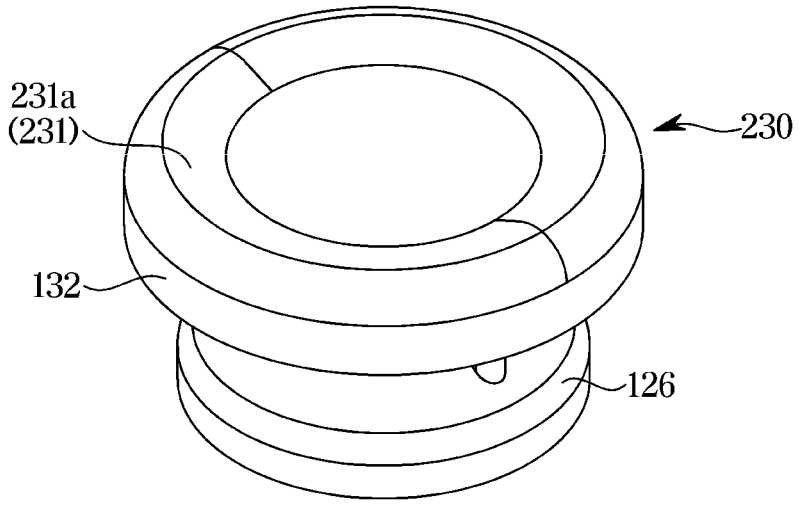
FIG. 8 shows a coupled state of an impeller cover and a diffuser device according to an embodiment of the disclosure.
Figure 9:
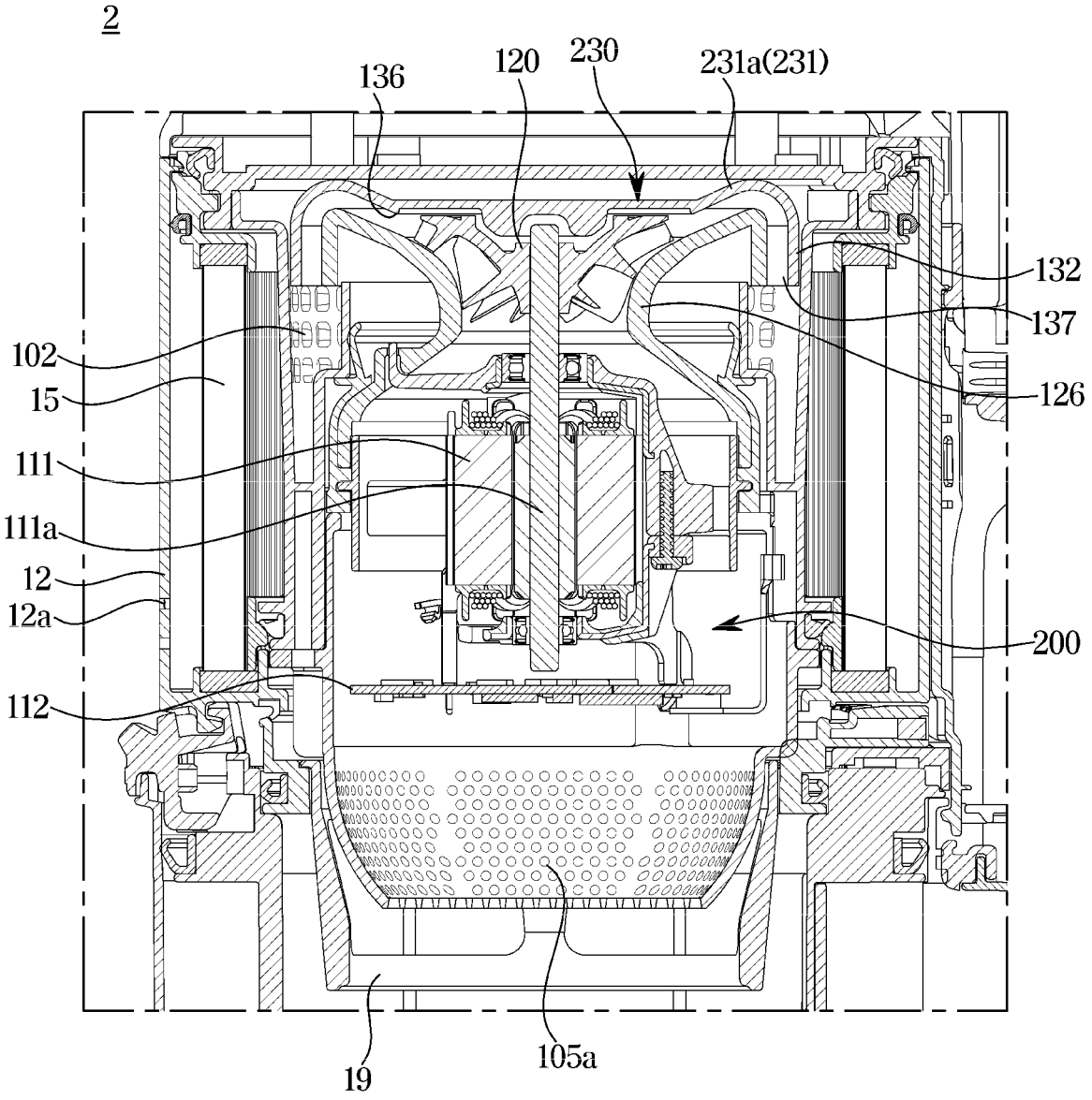
FIG. 9 shows a cleaner to which the diffuser device shown in FIG. 8 is applied according to an embodiment of the disclosure.

FIG. 8 shows a coupled state of an impeller cover and a diffuser device according to an embodiment of the disclosure. FIG. 9 shows a cleaner to which the diffuser device shown in FIG. 8 is applied.

A diffuser device 230 of a fan motor device 200 of a cleaner 2 according to an embodiment of the disclosure will be described with reference to FIGS. 8 and 9. In the following description about components of the cleaner 2 shown in FIGS. 8 and 9, the same components as those of the cleaner 1 shown in FIGS. 1 to 7 will be assigned like reference numerals, and detailed descriptions thereof will be omitted.

Referring to FIGS. 8 and 9, the fan motor device 200 of the cleaner 2 according to an embodiment of the disclosure may include the diffuser device 230. The diffuser device 230 may include a radiating diffuser 231 extending to guide air discharged from the impeller 120 in the radial direction from the rotational axis of the impeller 120, and an axial diffuser 132 extending to guide air passed through the radiating diffuser 131 to the filter 15.

In the radiating diffuser 231 of the diffuser device 230 shown in FIG. 9, the second radiating diffuser 131*b* of the radiating diffuser 131 of the diffuser device 130 shown in FIG. 7 may be omitted. The radiating diffuser 231 of the diffuser device 230 according to an embodiment of the disclosure may include a first radiating diffuser 231*a* extending in the direction in which the impeller 120 discharges air. The axial diffuser 132 may extend from the first radiating diffuser 231*a*.

Because the diffuser device 230 according to an embodiment of the disclosure includes the first radiating diffuser 231*a* at which the radiating diffuser 231 extends along a flow direction of air discharged from the impeller 120, and the diffuser device 230 omits a portion that extends to be substantially perpendicular to the rotational axis direction of the impeller 120, the diffuser device 230 may more effectively reduce turbulence and/or noise that is caused by air discharged from the impeller 120.

Figure 10:
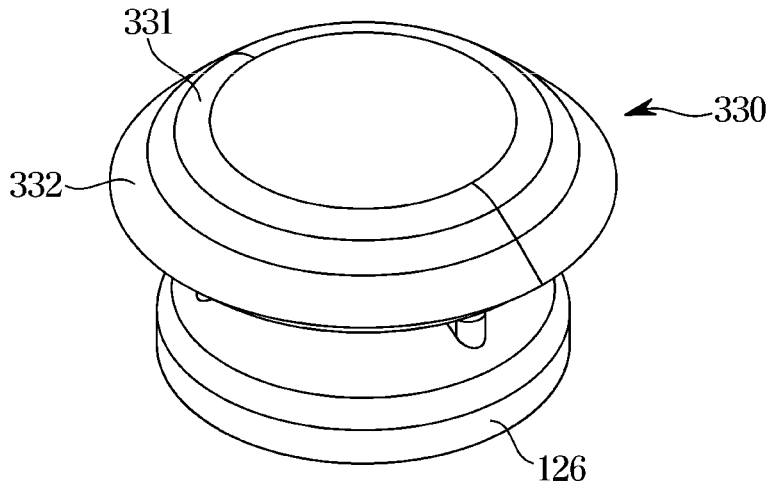
FIG. 10 shows a coupled state of an impeller cover and a diffuser device according to an embodiment of the disclosure.
Figure 11:
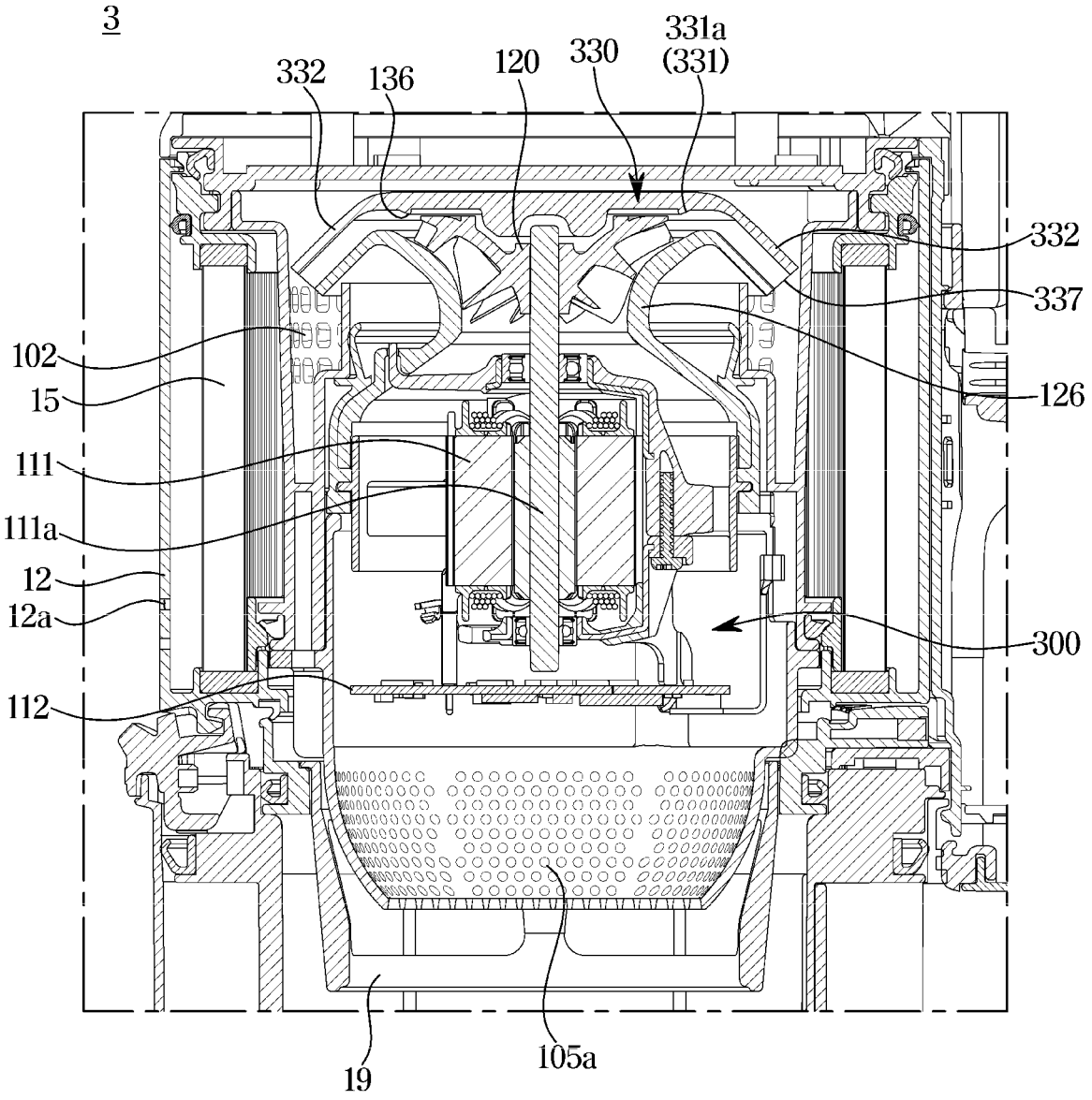
FIG. 11 shows a cleaner to which the diffuser device shown in FIG. 10 is applied according to an embodiment of the disclosure.

FIG. 10 shows a coupled state of an impeller cover and a diffuser device according to an embodiment of the disclosure. FIG. 11 shows a cleaner to which the diffuser device shown in FIG. 10 is applied.

A diffuser device 330 of a fan motor device 300 of a cleaner 3 according to an embodiment of the disclosure will be described with reference to FIGS. 10 and 11. In the following description about components of the cleaner 3 shown in FIGS. 10 and 11, the same components as those of the cleaner 1 shown in FIGS. 1 to 7 will be assigned like reference numerals, and detailed descriptions thereof will be omitted.

Referring to FIGS. 10 and 11, the fan motor device 300 of the cleaner 3 according to an embodiment of the disclosure may include a diffuser device 330. The diffuser device 330 may include a radiating diffuser 331 extending to guide air discharged from the impeller 120 in the radial direction from the rotational axis of the impeller 120, and an axial diffuser 332 extending to guide air passed through the radiating diffuser 331 to the filter 15.

In the radiating diffuser 331 of the diffuser device 330 shown in FIG. 11, the second radiating diffuser 131*b* of the radiating diffuser 131 of the diffuser device 130 shown in FIG. 7 may be omitted. The radiating diffuser 331 of the diffuser device 330 according to an embodiment of the disclosure may include a first radiating diffuser 331*a* extending in the direction in which the impeller 120 discharges air.

The axial diffuser 332 of the diffuser device 330 according to an embodiment of the disclosure may extend from the first radiating diffuser 331*a* toward the filter 15. The axial diffuser 332 of the diffuser device 330 may extend such that a diffuser outlet 337 is toward the filter 15. The axial diffuser 332 of the diffuser device 330 shown in FIG. 11 may be inclined with respect to the rotational axis direction of the impeller 120, compared to the axial diffuser 132 of the diffuser device 130 shown in FIG. 7.

Because the axial diffuser 332 extends from the radiating diffuser 331 toward the filter 15, the diffuser device 330 according to an embodiment of the disclosure may reduce turbulence and/or noise that may be generated from the filter 15 by air discharged from the diffuser device 330.

Figure 12:
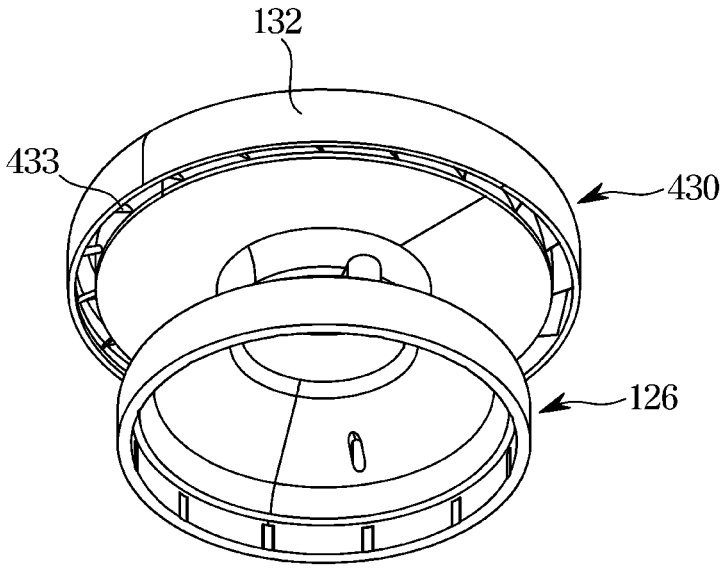
FIG. 12 shows a coupled state of an impeller cover and a diffuser device according to an embodiment of the disclosure.
Figure 13:
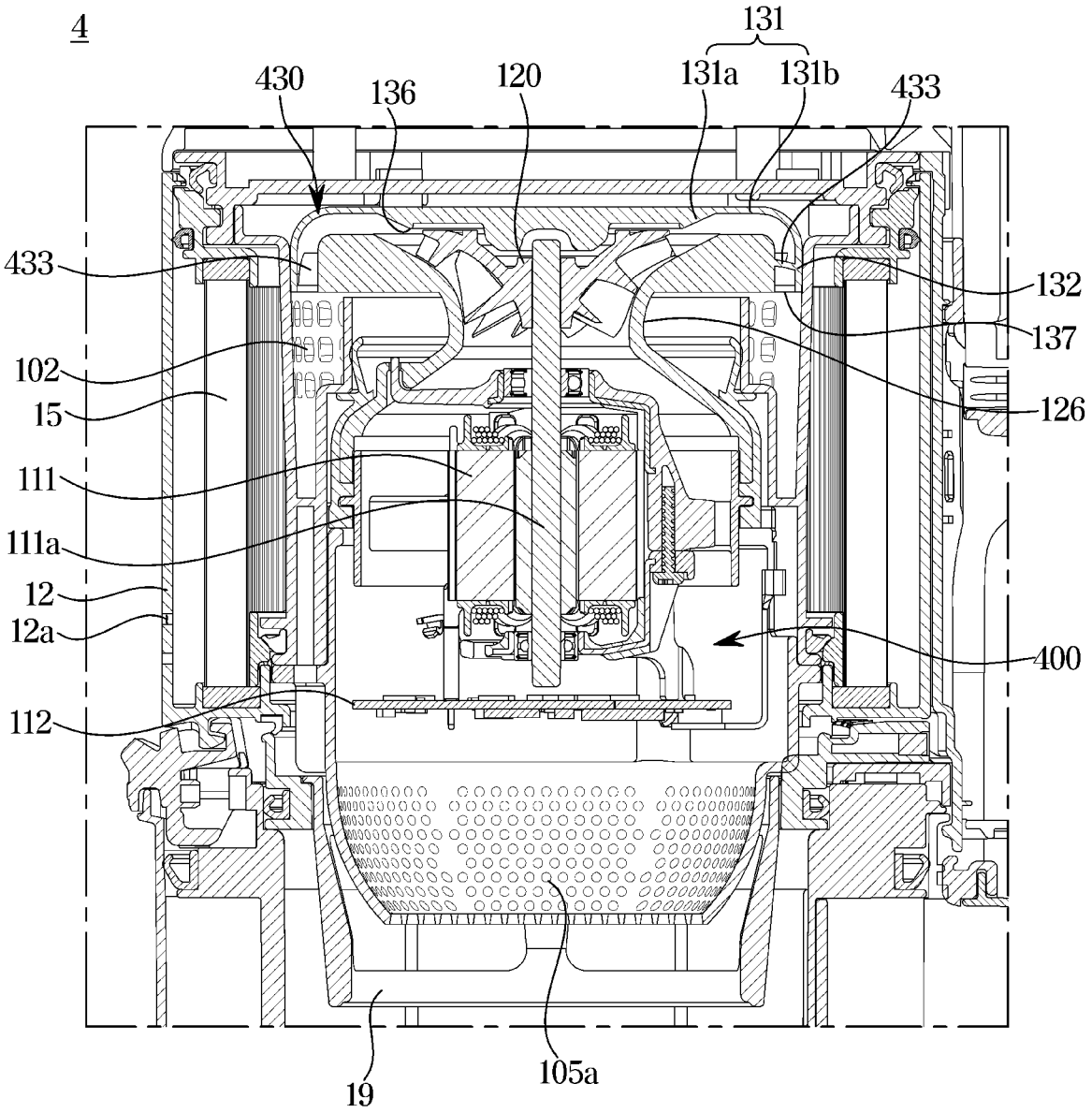
FIG. 13 shows a cleaner to which the diffuser device shown in FIG. 12 is applied according to an embodiment of the disclosure.

FIG. 12 shows a coupled state of an impeller cover and a diffuser device according to an embodiment of the disclosure. FIG. 13 shows a cleaner to which the diffuser device shown in FIG. 12 is applied.

A diffuser device 430 of a fan motor device 400 of a cleaner 4 according to an embodiment of the disclosure will be described with reference to FIGS. 12 and 13. In the following description about components of the cleaner 4 shown in FIGS. 12 and 13, the same components as those of the cleaner 1 shown in FIGS. 1 to 7 will be assigned like reference numerals, and detailed descriptions thereof will be omitted.

Referring to FIGS. 12 and 13, the fan motor device 400 of the cleaner 4 according to an embodiment of the disclosure may include a diffuser device 430. The diffuser device 430 may include the radiating diffuser 131 extending to guide air discharged from the impeller 120 in the radial direction from the rotational axis of the impeller 120, and the axial diffuser 132 extending to guide air passed through the radiating diffuser 331 to the filter 15. The radiating diffuser 131 may include the first radiating diffuser 131*a* extending in the direction in which the impeller 120 discharges air, and the second radiating diffuser 131*b* extending from the first radiating diffuser 131*a* in the direction that is substantially perpendicular to the rotational axis of the impeller 120.

The diffuser device 430 of the fan motor device 400 of the cleaner 4 according to an embodiment of the disclosure may include an axial blade 433 provided inside the axial diffuser 132. The axial blade 433 may diffuse air passing through the axial diffuser 132. Because the axial blade 433 is provided in the axial diffuser 132, the cleaner 4 according to an embodiment of the disclosure may improve efficiency.

Figure 14:
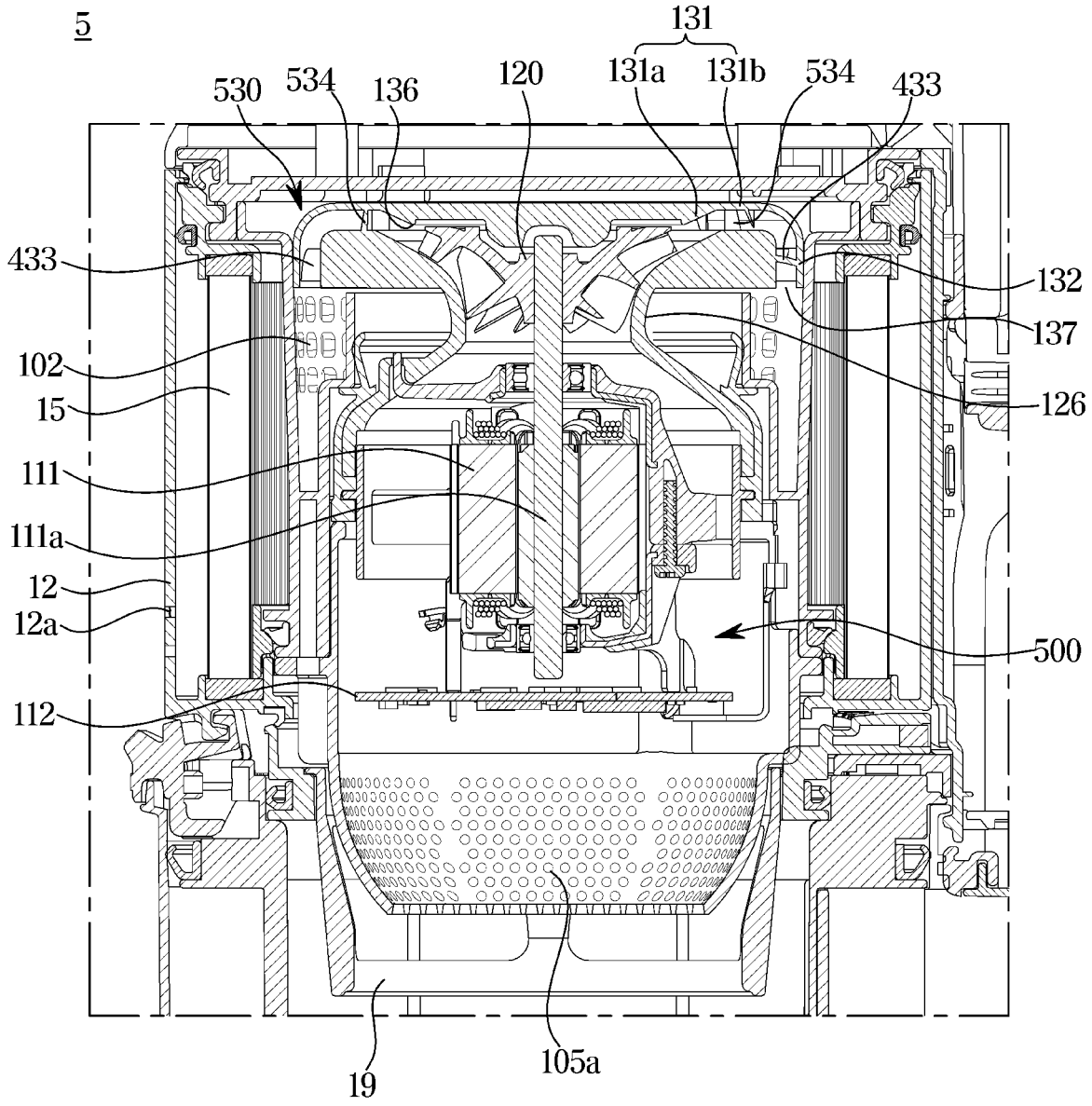
FIG. 14 shows a cleaner to which a diffuser device according to an embodiment of the disclosure is applied.

FIG. 14 shows a cleaner to which a diffuser device according to an embodiment of the disclosure is applied.

A diffuser device 530 of a fan motor device 500 of a cleaner 5 according to an embodiment of the disclosure will be described with reference to FIG. 14. In the following description about components of the cleaner 5 shown in FIG. 14 the same components as those of the cleaner 1 shown in FIGS. 1 to 7 or the cleaner 4 shown in FIG. 13 will be assigned like reference numerals, and detailed descriptions thereof will be omitted.

Referring to FIG. 14, the fan motor device 500 of the cleaner 5 according to an embodiment of the disclosure may include a diffuser device 530. The diffuser device 530 may include the radiating diffuser 131 extending to guide air discharged from the impeller 120 in the radial direction from the rotational axis of the impeller 120, and the axial diffuser 132 extending to guide air passed through the radiating diffuser 331 to the filter 15. The radiating diffuser 131 may include the first radiating diffuser 131*a* extending in the direction in which the impeller 120 discharges air, and the second radiating diffuser 131*b* extending from the first radiating diffuser 131*a* in the direction that is substantially perpendicular to the rotational axis of the impeller 120.

The diffuser device 530 of the fan motor device 500 of the cleaner 5 according to an embodiment of the disclosure may include the axial blade 433 provided inside the axial diffuser 132.

The diffuser device 530 of the fan motor device 500 of the cleaner 5 according to an embodiment of the disclosure may include a radiating blade 534 provided inside the radiating diffuser 131. The radiating blade 534 may be positioned at the second radiating diffuser 131*b* of the radiating diffuser 131. The radiating blade 534 may diffuse air passing through the radiating diffuser 131.

Because the axial blade 433 is provided in the axial diffuser 132 and the radiating blade 534 is provided in the radiating diffuser 131, the cleaner 5 according to an embodiment of the disclosure may improve efficiency.

Figure 15:
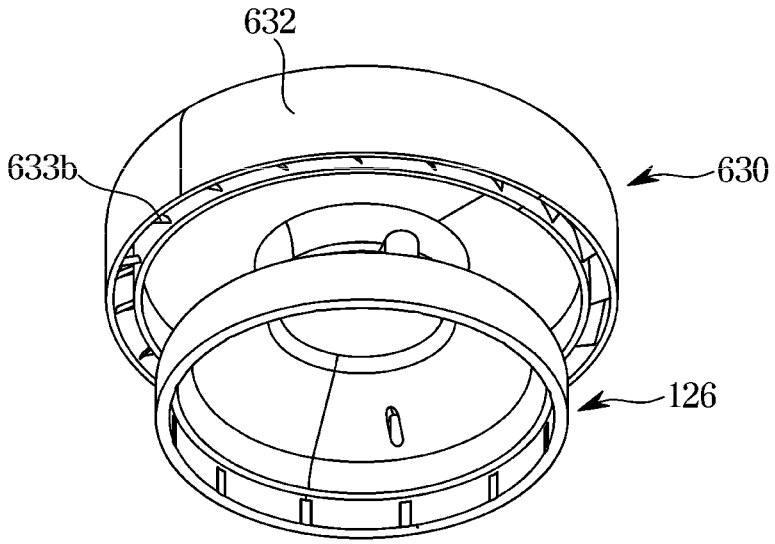
FIG. 15 shows a coupled state of an impeller cover and a diffuser device according to an embodiment of the disclosure.
Figure 16:
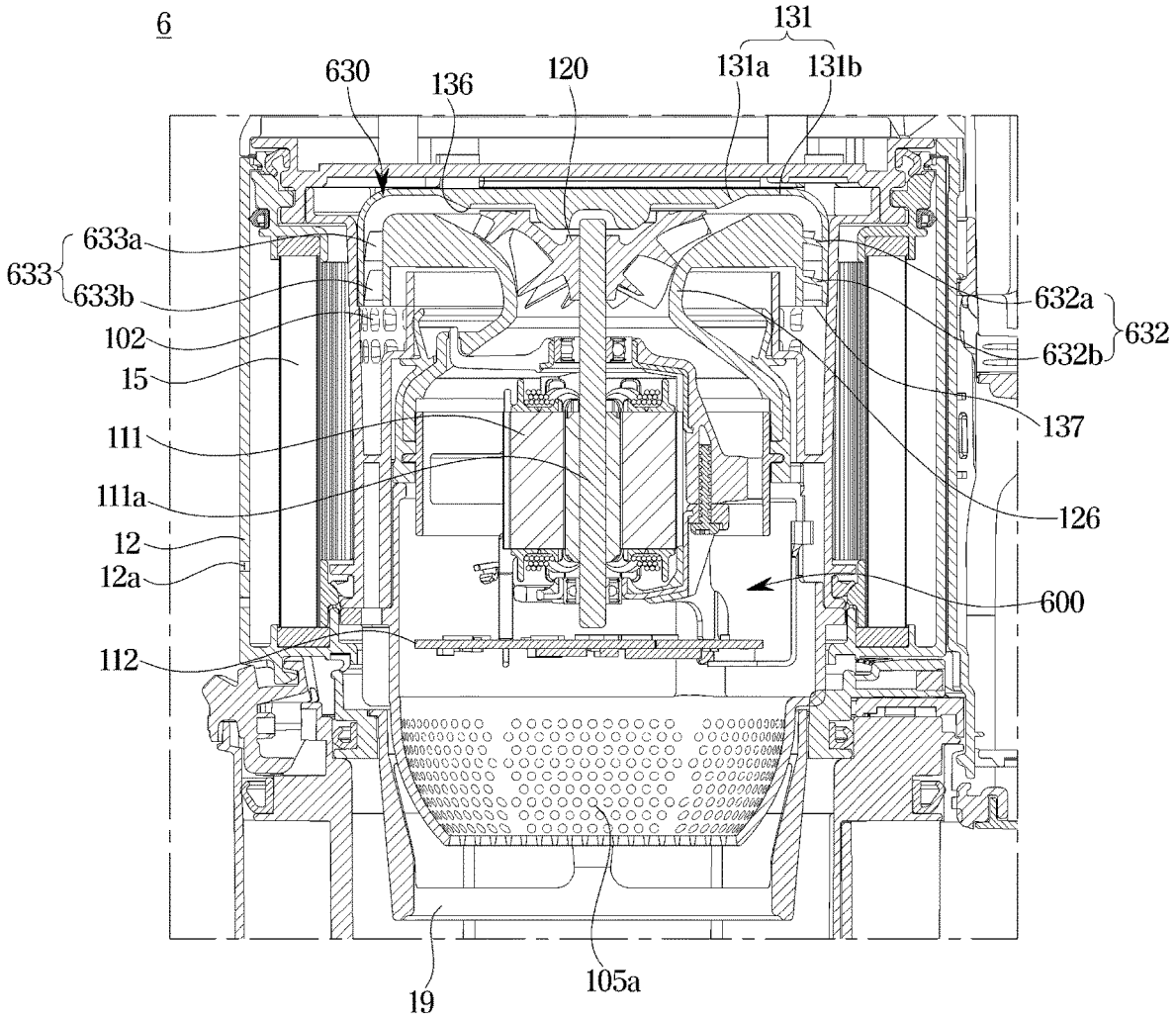
FIG. 16 shows a cleaner to which the diffuser device shown in FIG. 15 is applied according to an embodiment of the disclosure.

FIG. 15 shows a coupled state of an impeller cover and a diffuser device according to an embodiment of the disclosure. FIG. 16 shows a cleaner to which the diffuser device shown in FIG. 15 is applied.

A diffuser device 630 of a fan motor device 600 of a cleaner 6 according to an embodiment of the disclosure will be described with reference to FIGS. 15 and 16. In the following description about components of the cleaner 6 shown in FIGS. 15 and 16, the same components as those of the cleaner 1 shown in FIGS. 1 to 7 or the cleaner 4 shown in FIG. 13 will be assigned like reference numerals, and detailed descriptions thereof will be omitted.

Referring to FIGS. 15 and 16, the fan motor device 600 of the cleaner 6 according to an embodiment of the disclosure may include a diffuser device 630. The diffuser device 630 may include the radiating diffuser 131 extending to guide air discharged from the impeller 120 in the radial direction from the rotational axis of the impeller 120, and an axial diffuser 632 extending to guide air passed through the radiating diffuser 331 to the filter 15. The radiating diffuser 131 may include the first radiating diffuser 131*a* extending in the direction in which the impeller 120 discharges air, and the second radiating diffuser 131*b* extending from the first radiating diffuser 131*a* in the direction that is substantially perpendicular to the rotational axis of the impeller 120.

The axial diffuser 632 of the diffuser device 630 of the fan motor device 600 of the cleaner 6 according to an embodiment of the disclosure may include a first axial diffuser 632*a* extending from the radiating diffuser 131, and a second axial diffuser 632*b* extending from the first axial diffuser 632*a*. The first axial diffuser 632*a* and the second axial diffuser 632*b* may extend in a direction that is parallel to the rotational axis direction of the impeller 120. The first axial diffuser 632*a* and the second axial diffuser 632*b* may be stacked according to the rotational axis direction of the impeller 120. The first axial diffuser 632*a* and the second axial diffuser 632*b* may be arranged in series along the rotational axis direction of the impeller 120.

The diffuser device 630 of the fan motor device 600 of the cleaner 6 according to an embodiment of the disclosure may include an axial blade 633 provided inside the axial diffuser 632. The axial blade 633 may diffuse air passing through the axial diffuser 632. The axial blade 633 may include a first axial blade 633*a* provided in the first axial diffuser 632*a*, and a second axial blade 633*b* provided in the second axial diffuser 632*b*. The first axial blade 633*a* may diffuse air passing through the first axial diffuser 632*a*. The second axial blade 633*b* may diffuse air passing through the second axial diffuser 632*b*.

According to this configuration, because the axial diffuser 632 includes the first axial diffuser 632*a* and the second axial diffuser 632*b*, the first axial blade 633*a* is provided in the first axial diffuser 632*a*, and the second axial blade 633*b* is provided in the second axial diffuser 632*b*, the cleaner 6 according to an embodiment of the disclosure may improve efficiency.

Figure 17:
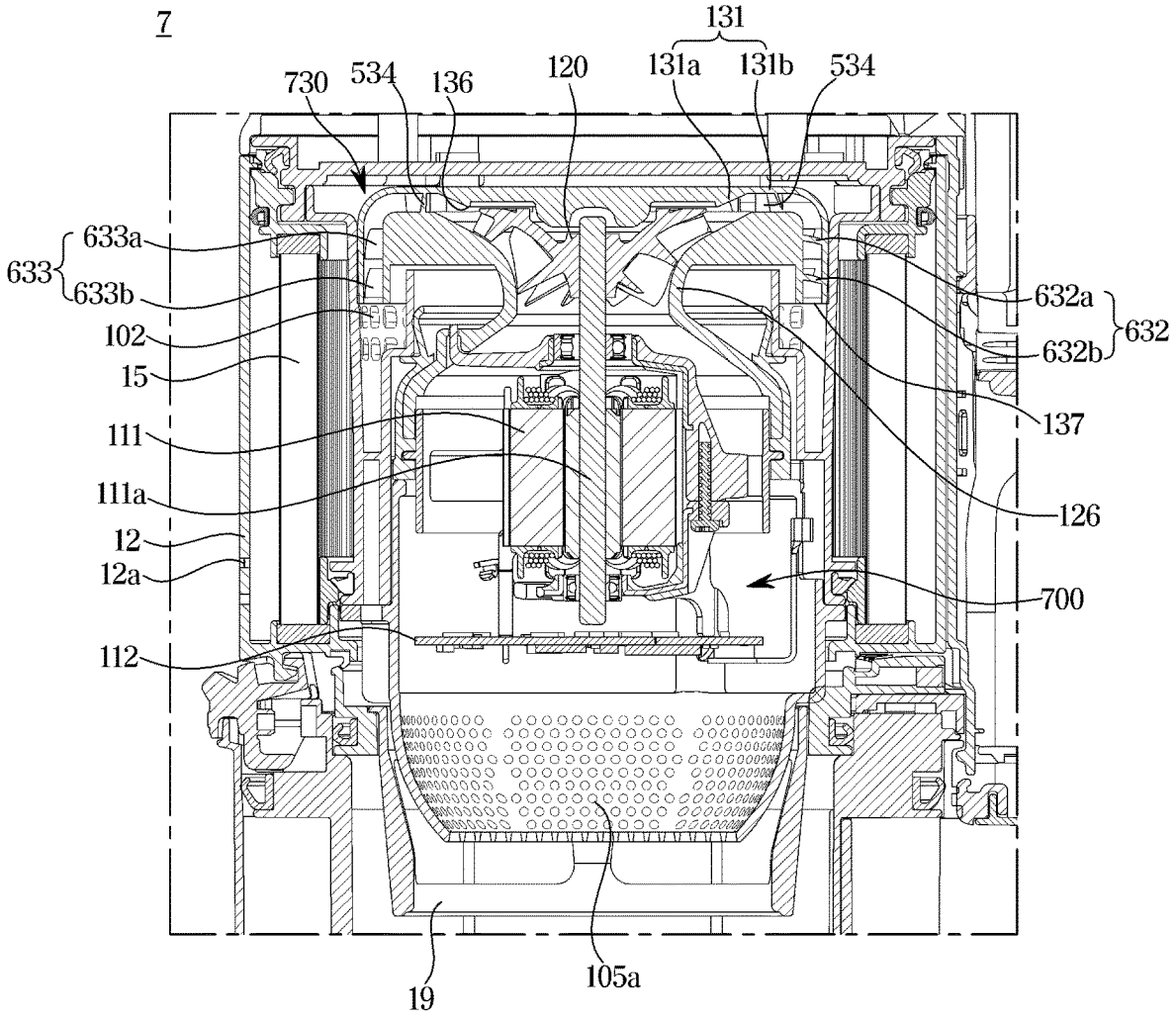
FIG. 17 shows a cleaner to which a diffuser device according to an embodiment of the disclosure is applied.

FIG. 17 shows a cleaner to which a diffuser device according to an embodiment of the disclosure is applied.

A diffuser device 730 of a fan motor device 700 of a cleaner 7 according to an embodiment of the disclosure will be described with reference to FIG. 17. In the following description about components of the cleaner 7 shown in FIG. 17 the same components as those of the cleaner 1 shown in FIGS. 1 to 7, the cleaner 5 shown in FIG. 14, or the cleaner 6 shown in FIG. 6 will be assigned like reference numerals, and detailed descriptions thereof will be omitted.

Referring to FIG. 17, the fan motor device 700 of the cleaner 7 according to an embodiment of the disclosure may include a diffuser device 730. The diffuser device 730 may include the radiating diffuser 131 extending to guide air discharged from the impeller 120 in the radial direction from the rotational axis of the impeller 120, and the axial diffuser 632 extending to guide air passed through the radiating diffuser 331 to the filter 15. The radiating diffuser 131 may include the first radiating diffuser 131*a* extending in the direction in which the impeller 120 discharges air, and the second radiating diffuser 131*b* extending from the first radiating diffuser 131*a* in the direction that is substantially perpendicular to the rotational axis of the impeller 120. The axial diffuser 632 may include the first axial diffuser 632*a* extending from the radiating diffuser 131, and the second axial diffuser 632*b* extending from the first axial diffuser 632*a*.

The diffuser device 730 of the fan motor device 700 of the cleaner 7 according to an embodiment of the disclosure may include the radiating blade 534 provided inside the radiating diffuser 131. The radiating blade 534 may diffuse air passing through the radiating diffuser 131.

The diffuser device 730 of the fan motor device 700 of the cleaner 7 according to an embodiment of the disclosure may include the axial blade 633 provided inside the axial diffuser 632. The axial blade 633 may diffuse air passing through the axial diffuser 632.

The axial blade 633 may include the first axial blade 633*a* provided in the first axial diffuser 632*a*, and the second axial blade 633*b* provided in the second axial diffuser 632*b*. The first axial blade 633*a* may diffuse air passing through the first axial diffuser 632*a*. The second axial blade 633*b* may diffuse air passing through the second axial diffuser 632*b*.

According to this configuration, because the radiating blade 534 is provided inside the radiating diffuser 131, the axial diffuser 632 includes the first axial diffuser 632*a* and the second axial diffuser 632*b*, the first axial blade 633*a* is provided in the first axial diffuser 632*a*, and the second axial blade 633*b* is provided in the second axial diffuser 632*b*, the cleaner 7 according to an embodiment of the disclosure may improve efficiency.

According to a concept of the disclosure, because the diffuser has a portion extending in the radial direction from the rotational axis of the impeller, the length of the cleaner may be reduced in the rotational axis direction of the impeller.

According to a concept of the disclosure, because the length of the cleaner in the rotational axis direction of the impeller is reduced, the weight of the cleaner may be reduced.

According to a concept of the disclosure, because the diffuser has a portion extending in the radial direction from the rotational axis of the impeller, the efficiency of the cleaner may be improved.

According to a concept of the disclosure, because the motor, the impeller, and the diffuser are arranged in order in the direction which air passed through the dust collecting device is discharged to the outside of the cleaner such that air having relatively low temperature passes through the motor, the cleaner may increase heat dissipation efficiency of the motor.

Embodiments of the disclosure may provide a cleaner including a body; a fan motor device configured to generate a suction force inside the body; and a filter positioned inside the body and configured to filter air passed through the fan motor device. The fan motor device may include: an impeller configured to generate a suction force; a motor positioned to one side of the impeller for intake of air, and configured to provide power to the impeller; and a diffuser device including a radiating diffuser extending to guide air discharged from the impeller in a radial direction from a rotational axis of the impeller, and an axial diffuser extending to discharge air passed through the radiating diffuser toward the one side of the impeller for intake of air.

The radiating diffuser may include a radiating blade configured to diffuse air passing through the radiating diffuser, and the axial diffuser may include an axial blade configured to diffuse air passing through the axial diffuser. The axial diffuser may include a first axial diffuser extending from the radiating diffuser, and including a first axial diffuser configured to diffuse air passing through the first axial diffuser; and a second axial diffuser extending from the first axial diffuser, and including a second axial blade configured to diffuse air passing through the second axial diffuser. The radiating diffuser may include a first radiating diffuser extending in a direction in which the impeller discharges air; and a second radiating diffuser extending from the first radiating diffuser in a direction that is perpendicular to a rotational axis of the impeller. The filter may surround the fan motor device in a circumferential direction with respect to the rotational axis of the impeller.

Effects that may be achieved by the concepts of the disclosure are not limited to the above-mentioned effects, and other effects not mentioned will be clearly understood by one of ordinary skill in the technical field to which the disclosure belongs from the following descriptions.

So far, specific embodiments have been shown and described, however, the disclosure is not limited to these embodiments. It should be interpreted that various modifications may be made by one of ordinary skill in the technical art to which the disclosure belongs, without deviating from the gist of the technical concept of the disclosure, which is defined in the following claims.

What is claimed is:

1. A cleaner comprising:

a body including a body exhaust vent;

a filter installable inside the body; and a fan motor device including:

an impeller configured to be rotatable to generate a suction force inside the body, a motor configured to provide power to rotate the impeller, and a diffuser device arranged about the impeller and including:

a radiating diffuser extending in a radial direction from a rotational axis of the impeller so as to surround the impeller, and an axial diffuser extending integrally from the radiating diffuser so as to surround the impeller, wherein the fan motor device is configured so that, with the filter installed inside the body, rotation of the impeller by the power provided by the motor causes air to pass through the fan motor device about the motor before reaching the impeller, and then be discharged from the impeller directly into the diffuser device, and then guided by the radiating diffuser in the radial direction from the rotational axis of the impeller, and then guided by the axial diffuser to the filter to be filtered, and then discharged through the body exhaust vent, and the diffuser device is configured to discharge the air in an opposite direction to which the air enters the impeller.

2. The cleaner of claim 1, wherein
the radiating diffuser includes a radiating blade configured to diffuse the air guided by the radiating diffuser.

3. The cleaner of claim 1, wherein
the axial diffuser includes an axial blade configured to diffuse the air guided by the axial diffuser.

4. The cleaner of claim 1, wherein
the axial diffuser includes:
a first axial diffuser extending from the radiating diffuser, and
a second axial diffuser extending from the first axial diffuser.

5. The cleaner of claim 4, wherein
the first axial diffuser includes:
a first axial blade configured to diffuse air guided by the first axial diffuser, and
the second axial diffuser includes:
a second axial blade configured to diffuse air guided by the second axial diffuser.

6. The cleaner of claim 1, wherein
the radiating diffuser includes a first radiating diffuser extending in a direction in which the impeller discharges air.

7. The cleaner of claim 6, wherein
the radiating diffuser includes a second radiating diffuser extending from the first radiating diffuser in a direction that is perpendicular to the rotational axis of the impeller.

8. The cleaner of claim 1, wherein
the axial diffuser is configured to discharge the air guided by the axial diffuser in a direction toward the filter with the filter installed inside the body.

9. The cleaner of claim 1, wherein
the motor is positioned to a side of the impeller opposite to the diffuser device.

10. The cleaner of claim 1, wherein
with the filter installed inside the body, the filter surrounds the fan motor device in a circumferential direction with respect to the rotational axis of the impeller.

11. The cleaner of claim 1, wherein
the diffuser device is configured to discharge air in the opposite direction so as to flow to an inner surface of the filter.

12. The cleaner of claim 1, wherein
the diffuser device includes:
an outlet to discharge the air guided by the axial diffuser, the outlet being positioned adjacent to a first side of the filter with the filter installed inside the body, and
the body exhaust vent is positioned adjacent to a second side of the filter opposite to the first side of the filter with the filter installed inside the body.

13. The cleaner of claim 1, wherein
the diffuser device includes:
an outlet to discharge the air guided by the axial diffuser, and
the filter extends from the outlet of the diffuser device to the body exhaust vent with the filter installed inside the body.

14. The cleaner of claim 1, wherein
the filter is a high efficiency particulate air (HEPA) filter.

15. The cleaner of claim 1, wherein
the filter is detachable from the body.

* * * * *